US008764521B2

(12) United States Patent
Sogawa et al.

(10) Patent No.: US 8,764,521 B2
(45) Date of Patent: Jul. 1, 2014

(54) GRIND-STONE-MOUNT OF HONING HEAD

(75) Inventors: Kazushi Sogawa, Tochigi (JP); Hideo Fujiwara, Tochigi (JP); Kazuya Kodama, Tochigi (JP); Jin Fukumitsu, Tochigi (JP)

(73) Assignee: Honda Motor Co., Ltd., Tokyo (JP)

( * ) Notice: Subject to any disclaimer, the term of this patent is extended or adjusted under 35 U.S.C. 154(b) by 108 days.

(21) Appl. No.: 13/380,087

(22) PCT Filed: Jul. 1, 2010

(86) PCT No.: PCT/JP2010/061285

§ 371 (c)(1),
(2), (4) Date: Dec. 22, 2011

(87) PCT Pub. No.: WO2011/002069

PCT Pub. Date: Jan. 6, 2011

(65) Prior Publication Data

US 2012/0094583 A1 Apr. 19, 2012

(30) Foreign Application Priority Data

Jul. 1, 2009 (JP) ..... 2009-156649

(51) Int. Cl.
*B24B 33/08* (2006.01)

(52) U.S. Cl.
USPC ..... 451/485

(58) Field of Classification Search
USPC ..... 451/485
See application file for complete search history.

(56) References Cited

U.S. PATENT DOCUMENTS

| | | | | | |
|---|---|---|---|---|---|
| 1,393,625 | A | * | 10/1921 | Hobbs | 451/485 |
| 1,484,353 | A | * | 2/1924 | Kidwell | 451/485 |
| RE16,138 | E | * | 8/1925 | Powell | 451/485 |
| 1,673,924 | A | * | 6/1928 | Snyder | 451/485 |
| 2,099,207 | A | * | 11/1937 | Hill et al. | 451/485 |
| 2,320,747 | A | * | 6/1943 | Peterson et al. | 451/481 |
| 2,340,018 | A | * | 1/1944 | Rickrode | 451/485 |
| 2,340,767 | A | * | 2/1944 | Prange | 451/479 |
| 2,657,506 | A | * | 11/1953 | Hadley et al. | 451/485 |

FOREIGN PATENT DOCUMENTS

| | | | |
|---|---|---|---|
| CN | 201198113 | Y | 2/2009 |
| CN | 201198114 | Y | 2/2009 |
| JP | 63-030471 | U | 2/1988 |
| JP | 6-027066 | U | 4/1994 |
| JP | 8-155826 | A | 6/1996 |
| JP | 9-193001 | A | 7/1997 |

* cited by examiner

*Primary Examiner* — Maurina Rachuba
(74) *Attorney, Agent, or Firm* — Carrier Blackman & Associates, P.C.; Joseph P. Carrier; William D. Blackman

(57) ABSTRACT

A plurality of grind-stone-mounts 12 each having a grind stone 15 on its outer side are attached to a holder 11 of a honing head 10 expandably along a radial direction. Each of the grind-stone-mounts 12 is provided with a support part 13 disposed inside along the radial direction, and a grind part 14 including the grind stone 15 and disposed outside along the radial direction. The grind part 14 is swingably attached to the support part 13 through one or more spring members 16 disposed at intervals along an axial direction of the holder 11.

4 Claims, 4 Drawing Sheets

GRIND-STONE-MOUNT OF HONING HEAD

TECHNICAL FIELD

The present invention relates to a grind-stone-mount of a honing head. More specifically, it relates to a grind-stone-mount of a honing head used for honing of an inside diameter of a hole in a shape of a non-circular cross section formed in a workpiece.

BACKGROUND ART

In a production process for automobiles, bores of cylinder blocks of engines are cut, and thereafter, cylinder heads and crank cases are assembled on the cylinder blocks. Since a piston to be placed in a bore is in a shape of a circular cross section, the bore is cut so as to attain a state where its cross section is close to a true circle.

However, even if each bore of the cylinder block is cut into a shape of a circular cross section, when the cylinder head, the crank case and the like are assembled to the cylinder block, the shape of the bore is deformed. Such deformation of the bore may be a factor to increase slide resistance between the bore and the piston caused in use of the engine, and it is apprehended that the engine may not be able to exhibit desired performance.

Therefore, in cutting the bore of the cylinder block, the bore is worked with a dummy head acting like a cylinder head attached to the cylinder block, and after completing the working of the bore, the dummy head is removed. However, when the dummy head or the like is attached and removed every time the bore of the cylinder head is worked, there arises a problem that the productivity is largely degraded.

In order to solve this problem, the following method has been proposed: First, a dummy head is attached to a cylinder head, so as to work a bore into a shape of a circular cross section by using a machining tool.

Next, the dummy head is removed from the cylinder block. Then, stress caused by the dummy head attached thereto is released, and hence, the bore is deformed into a shape of a non-circular cross section. The entire shape of the bore attained after removing the dummy head is measured so as to create NC data. Alternatively, data of the shape of the bore is obtained through simulation. Thereafter, the cylinder block is bored without attaching the dummy head thereto on the basis of the created NC data or the obtained shape data. In this manner, even when a bore is worked without attaching the dummy head to the cylinder block, the bore attains a true circular shape when a cylinder head is attached thereto.

For achieving this method, it is necessary to perform honing of the inside diameter of a bore in a shape of a non-circular cross section after performing the boring in the cylinder block. However, a grind-stone-mount of a conventional honing head used in the honing is made of a metal and is not deformable. Therefore, a cutting (grinding and polishing) amount is large in a portion where the contact pressure of a grind stone against the inside diameter of the bore in a shape of a non-circular cross section is high and the cutting (grinding and polishing) amount is small in a portion where the contact pressure of the grind stone is low. As a result, the shape of the bore attained after completing the honing is unavoidably in a state close to a shape of a circular cross section again from the shape of the non-circular cross section obtained through the boring.

Accordingly, a honing head for keeping the contact pressure of a grind stone substantially constant in the honing has been proposed (see Patent Document 1).

PRIOR ART DOCUMENT

Patent Document

Patent Document 1: JP-A-08-155826

However, the honing head described in Patent Document 1 has the following problem: Since an elastic body is provided between a main body shoe and an auxiliary shoe of a grind stone shoe from an upper end to a lower end of the grind stone shoe continuously with no intervals, the auxiliary shoe may not swing in regard to the main body shoe. In other words, it is not possible to make, for example, merely an upper end side of the auxiliary shoe move close to or away from the main body shoe, to make merely a lower end side move close to or away from the main body shoe, or to make the lower end side move away from or close to the main body shoe while the upper end side moving close to or away from the main body shoe.

In the NC data created as described above, the inside shape of a bore in the shape of a non-circular cross section includes not only a portion kept in parallel to the axial direction but also a portion shifted from the parallel direction. Therefore, the inside shape of the bore of the cylinder block obtained through the boring performed on the basis of such NC data includes a portion shifted from a direction parallel to the axial direction.

When the inside of such a bore is honed by using the honing head described in Patent Document 1, the auxiliary shoe of the grind stone shoe may not follow the shape of the inside of the bore in the portion shifted from the direction parallel to the axial direction, and hence this portion is scraped off.

In other words, the bore in the shape of a non-circular cross section obtained through the boring is scraped off so as to make the shape closer to the shape of a circular cross section.

SUMMARY OF INVENTION

One or more embodiments of the invention provide a grind-stone-mount of a honing head in which not only a contact pressure of a grind stone may be kept substantially constant but also the grind stone may follow an inside shape even in a portion shifted from a direction parallel to an axial direction.

According to one or more embodiments of the invention, a grind-stone-mount of a honing head is a grind-stone-mount for a honing head in which a plurality of grind-stone-mounts (such as grind-stone-mounts 12 described later) each having a grind stone (such as a grind stone 15 described later) on its outer side are attached expandably along a radial direction to a holder (such as a holder 11 described later) of the honing head, (such as a honing head 10 described later), and the grind-stone-mount is divided into a support part (such as a support part 13 described later) disposed inside along the radial direction and a grind part (such as a grind part 14 described later) having the grind stone and disposed outside along the radial direction. The grind part is swingably attached to the support part through one or a plurality of spring members (such as a coil spring 16 described later) disposed at intervals along an axial direction of the holder.

When this structure is employed, a contact pressure of the grind stone may be kept substantially constant by the spring member, and in addition, the grind part may be swung in regard to the support part with the spring member used as a fulcrum. Therefore, the grind stone may be made to smoothly follow an inside shape of a hole of a workpiece even in a portion shifted from a direction parallel to the axial direction, and hence, honing (including rough machining and surface finishing) may be performed while keeping the original inside shape of the hole.

According to one or more embodiments of the invention, a grind-stone-mount of a honing head is a grind-stone-mount for a honing head in which a plurality of grind-stone-mounts (such as grind-stone-mounts 42 described later) each having a grind stone (such as a grind stone 45, 45*a* or 45*b* described later) on its outer side are attached expandably along a radial direction to a holder (such as a holder 41 described later) of the honing head (such as a honing head 40 described later), and the grind-stone-mount is divided into a support part (such as a support part 43 described later) disposed inside along the radial direction and a grind part (such as a grind part 44 described later) having the grind stone and disposed outside along the radial direction. The grind part is divided into a plurality of grind stone members (such as grind stone members 44*a* and 44*b* described later) along an axial direction of the holder. Each grind stone member is swingably attached to the support part through one or a plurality of spring members (such as a coil springs 46*a* and 46*b* described later) disposed at intervals along the axial direction of the holder.

Also when this structure is employed, the same effects as those described above may be attained. Furthermore, since the grind part is divided into a plurality of grind stone members along the axial direction, even when a hole of a workpiece has a complicated inside shape along the axial direction, the grind stone may be made to smoothly follow the shape.

Each of the one or plurality of spring members may be a coil spring.

When this structure is employed, since a coil spring is used as a fulcrum of the swing, the grind part or the grind stone member may be smoothly swung.

The grind part or the grind stone member may be attached to the support part swingably with a plurality of coil springs having spring constants individually selected.

When this structure is employed, a mode of the swing of the grind part or the grind stone member may be set as desired by individually selecting the spring constants of the plural coil springs.

When the structure of any of the embodiments of the invention is employed, the contact pressure of the grind stone may be kept substantially constant by the spring member, and in addition, the grind part may be swung in regard to the support part with the spring member used as a fulcrum. Therefore, the grind stone may be made to smoothly follow the inside shape of a is hole of a workpiece even in a portion shifted from a direction parallel to the axial direction, and hence, the honing (including rough machining and surface finishing) may be performed while keeping the original inside shape of the hole.

DESCRIPTION OF EMBODIMENTS

Figure 1:
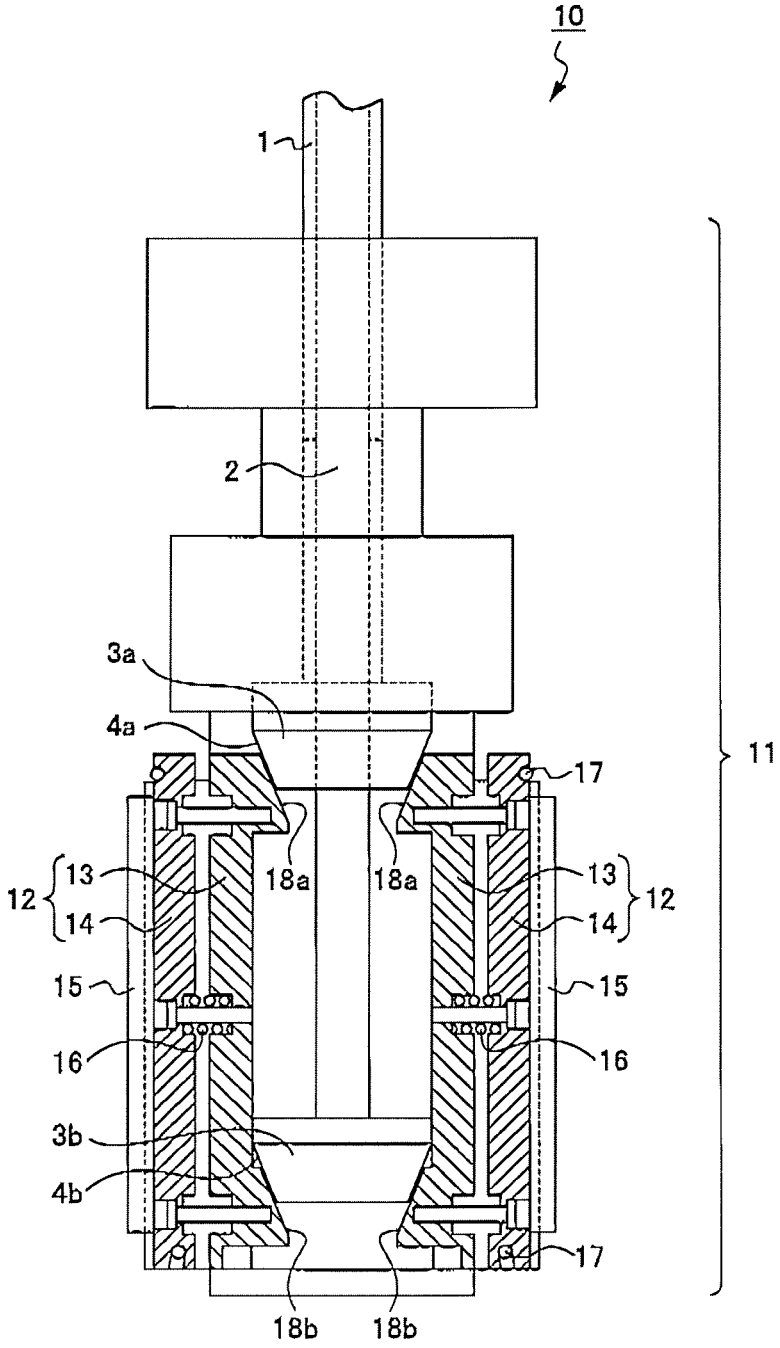
FIG. 1 is a schematic vertical cross-sectional view of a honing head including a grind-stone-mount according to a first exemplary embodiment of the invention.

Exemplary embodiments of the invention will be described with reference to the accompanying drawings. FIG. 1 is a schematic vertical cross-sectional view of a honing head 10 including a grind-stone-mount 12 according to a first exemplary embodiment of the invention.

As illustrated in FIG. 1, the honing head 10 is removably attached, for use, to a lower end portion of a spindle 1 rotatably and vertically movably provided on a honing machine (not shown).

The honing head 10 includes a substantially cylindrical holder 11 attached to the lower end portion of the spindle 1 and a plurality of grind-stone-mounts 12 respectively disposed in a plurality of slits formed at prescribed intervals along a circumferential direction of the holder 11. In FIG. 1, merely two grind-stone-mounts 12 disposed to oppose each other are illustrated.

The grind-stone-mounts 12 are attached to the holder 11 to be expandable along radial directions (namely, along directions away from the central axis of the holder 11 in FIG. 1). The plural grind-stone-mounts 12 are identical to one another, and each grind-stone-mount 12 includes a grind stone 15 on its outer side.

Each grind-stone-mount 12 is dividedly constructed by a support part 13 disposed inside along the radial direction and a grind part 14 having the grind stone 15 and disposed outside along the radial direction. The grind part 14 is attached swingably to the support part 13 with a single spring member 16 disposed at substantially an intermediate height of the whole length (i.e., the vertical length in FIG. 1) of the grind part 14. At this point, the single spring member 16 is preferably a coil spring.

All of the grind-stone-mounts 12 are held on the holder 11 under impetus provided inward in the radial directions by springs 17 hung and stretched between upper and lower ends thereof. Prescribed tapered faces 18*a* and 18*b* are formed on an inner face of each grind-stone-mount 12, namely, in upper and lower end portions on an inner face of the support part 13.

In a hollow cavity of the spindle 1, a rod 2 vertically movable in regard to the spindle 1 is disposed, and a lower portion of the rod 2 is provided with taper members 3*a* and 3*b* respectively having tapered faces 4*a* and 4*b* corresponding to the tapered faces 18*a* and 18*b* of the support part 13. The rod 2 is held always under impetus provided upward by a spring not shown. Furthermore, the rod 2 may be lowered in regard to the spindle 1 against the spring by operating an appropriate operating member such as a hydraulic cylinder not shown. When the rod 2 is lowered, the tapered faces 4*a* and 4*b* of the taper members 3*a* and 3*b* push the tapered faces 18*a* and 18*b* of the support part 13, so as to expand the grind-stone-mounts 12 in the radial directions.

The honing head 10 having the aforementioned structure is attached to the lower end portion of the spindle 1 of the honing machine, the honing head 10 is inserted into a worked hole of a workpiece, and the grind-stone-mounts 12 are expanded in the radial directions so as to bring grinding faces of the grind stones 15 into pressure contact with the inside face of the worked hole of the workpiece. The honing of the worked hole is performed by vertically moving the spindle 1 while rotating in this state.

In using the grind-stone-mounts 12 of the honing head 10 in the honing, the grind part 14 is attached to the support part 13 swingably with the single coil spring 16 disposed at substantially the intermediate height of the grind part 14. Therefore, the grind part 14 may be swung in regard to the support part 13 with the coil spring 16 used as a fulcrum.

In other words, the grinding face of the grind part 14 (namely, the grinding face of the grind stone 15) may face to a vertical plane parallel to the axial direction of the holder 11. Therefore, in the case where the worked hole of the workpiece has a vertical face parallel to the axial direction, the grinding face of the grind part 14 may smoothly follow the vertical face of the worked hole.

Furthermore, the grinding face of the grind, part 14 may be inclined from the vertical plane in, for example, a direction in which the upper end side of the grinding face of the grind part 14 is close to the upper end side of the support part 13 and the lower end side of the grinding face of the grind part 14 is away from the lower end side of the support part 13. Therefore, in the case where the worked hole of the workpiece has a portion shifted from the direction parallel to the axial direction to the inclined direction, the grinding face of the grind part 14 may smoothly follow the inclined face of the worked hole.

Alternatively, the grinding face of the grind part 14 may be inclined from the vertical plane in, for example, a direction in which the upper end side of the grinding face of the grind part 14 is away from the upper end side of the support part 13 and the lower end side of the grinding face of the grind part 14 is close to the lower end side of the support part 13. Therefore, in the case where the worked hole of the workpiece has a portion shifted from the direction parallel to the axial direction to the inclined direction, the grinding face of the grind part 14 may smoothly follow the inclined face of the worked hole.

In addition, the grinding face of the grind part 14 may keep the contact pressure of the grind stone 15 substantially constant because a radial length from the central axis of the holder 11 to the grinding face may be increased/decreased by extending/shrinking the coil spring 16 in accordance with an external force applied by the worked hole of the workpiece. Additionally, the radial length may be increased/decreased when the grinding face of the grind part 14 follows a vertical face or when it follows a face inclined in any of the directions.

Accordingly, the grinding face of the grind part 14 may smoothly follow the inside shape of the worked hole of the workpiece, and as a result, the honing (including rough machining and surface finishing) may be performed while keeping a shape of a non-circular cross section obtained through boring without scraping the original shape of the non-circular cross section otherwise scraped to be closer to a shape of a circular cross section.

Figure 2:
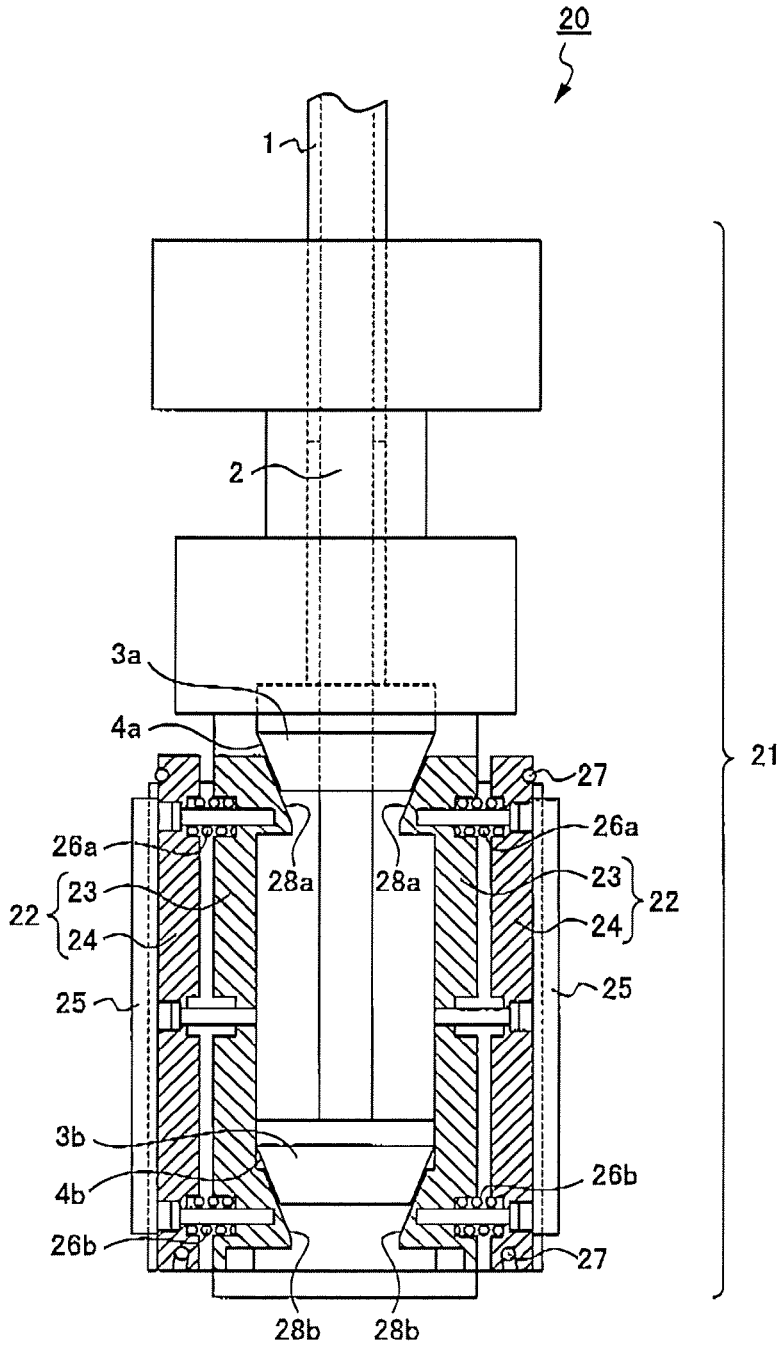
FIG. 2 is a schematic vertical cross-sectional view of a honing head including a grind-stone-mount according to a second exemplary embodiment of the invention.

FIG. 2 is a schematic vertical cross-sectional view of a honing head 20 including a grind-stone-mount 22 according to a second exemplary embodiment of the invention.

The honing head 20 of FIG. 2 is substantially the same as the honing head 10 of FIG. 1, and hence, reference numerals respectively obtained by adding 10 to the reference numerals used in FIG. 1 are used to refer to like elements, so as to avoid repetition of the description.

As illustrated in FIG. 2, a grind part 24 is attached to a support part 23 swingably with a spring member 26*a* disposed on an upper end side of the grind part 24 and a spring member 26*b* disposed on a lower end side of the grind part 24. At this point, each of the spring members 26*a* and 26*b* is preferably a coil spring.

In this case, spring constants of the coil springs 26*a* and 26*b* may be substantially the same, and it is possible to use coil springs 26*a* and 26*b* having different spring constants if necessary.

The honing head 20 having the aforementioned structure is attached to a lower end portion of a spindle 1 of a honing machine, the honing head 20 is inserted into a worked hole of a workpiece, and grind-stone-mounts 22 are expanded in the radial directions so as to bring grinding faces of grind stones 25 into pressure contact with the inside of the worked hole of the workpiece. The honing of the worked hole is performed by vertically moving the spindle 1 while rotating in this state.

In using such grind-stone-mounts 22 of the honing head 20 in the honing, the grind part 24 is attached to the support part 23 swingably with the coil spring 26*a* disposed on the upper end side of the grind part 24 and the coil spring 26*b* disposed on the lower end side of the grind part 24. Therefore, the grind part 24 may be swung in regard to the support part 23 with the coil spring 26*a* or 26*b* used as a fulcrum.

In other words, the grinding face of the grind part 24 (namely, the grinding face of the grind stone 25) may face to a vertical plane parallel to the axial direction of a holder 21. Therefore, in the case where the worked hole of the workpiece has a vertical face parallel to the axial direction, the grinding face of the grind part 24 may smoothly follow the vertical face of the worked hole.

Furthermore, in the case where, for example, a larger inward external force is applied to the upper end side of the grinding face of the grind part 24 than to the lower end side of the grind part 24, the coil spring 26*a* may be more largely shrunk than the coil spring 26*b*. Therefore, the grinding face of the grind part 24 may be inclined from the vertical plane to a direction where the upper end side of the grinding face of the grind part 24 is close to the support part 23 more largely than the lower end side. Accordingly, in the case where the worked hole of the workpiece has a portion shifted from the direction parallel to the axial direction to the inclined direction, the grinding face of the grind part 24 may smoothly follow the inclined face of the worked hole.

Alternatively, in the case where, for example, a larger inward external force is applied to the lower end side of the grind part 24 than to the upper end side of the grinding face of the grind part 24, the coil spring 26*b* may be more largely shrunk than the coil spring 26*a*. Therefore, the grinding face of the grind part 24 may be inclined from the vertical plane to a direction where the lower end side of the grinding face of the grind part 24 is close to the support part 23 more largely than the upper end side. Therefore, in the case where the worked hole of the workpiece has a portion shifted from the direction parallel to the axial direction to the inclined direction, the grinding face of the grind part 24 may smoothly follow the inclined face of the worked hole.

In addition, the grinding face of the grind part 24 may keep the contact pressure of the grind stone 25 substantially constant because a radial length from the central axis of the holder 21 to the grinding face may be increased/decreased by extending/shrinking the coil springs 26*a* and 26*b* in accordance with an external force applied by the worked hole of the workpiece Additionally, the radial length may be increased/decreased when the grinding face of the grind part 24 follows a vertical face or when it follows a face inclined in any of the directions.

Accordingly, the grinding face of the grind part 24 may smoothly follow the inside shape of the worked hole of the workpiece, and as a result, the honing (including rough machining and surface finishing) may be performed while keeping a shape of a non-circular cross section obtained through boring without scraping the original shape of the non-circular cross section otherwise scraped to be closer to a shape of a circular cross section.

Figure 3:
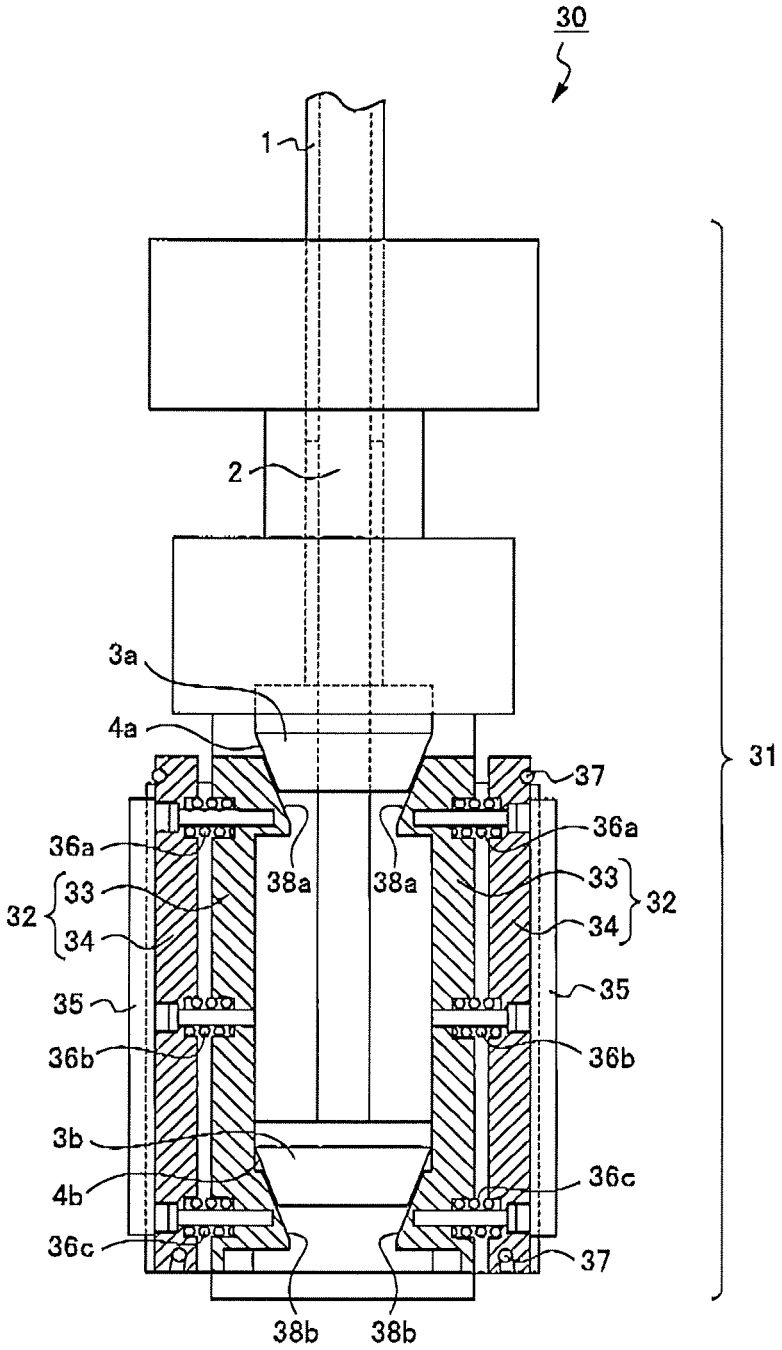
FIG. 3 is a schematic vertical cross-sectional view of a honing head including a grind-stone-mount according to a third exemplary embodiment of the invention.

FIG. 3 is a schematic vertical cross-sectional view of a honing head 30 including a grind-stone-mount 32 according to a third exemplary embodiment of the invention.

The honing head 30 of FIG. 3 is substantially the same as the honing head 10 of FIG. 1, and hence, reference numerals respectively obtained by adding 20 to the reference numerals used in FIG. 1 are used to refer to like elements, so as to avoid repetition of the description.

As illustrated in FIG. 3, a grind part 34 is attached to a support part 33 swingably with a spring member 36*a* disposed on an upper end side of the grind part 34, a spring member 36*b* disposed at a substantially intermediate height of the grind part 34 and a spring member 36*c* disposed on a lower end side of the grind part 34. At this point, each of the spring members 36*a*, 36*b* and 36*c* is preferably a coil spring.

In this case, spring constants of the coil springs 36*a*, 36*b* and 36*c* are preferably selected as follows: For example, the spring constants of the coil springs 36*a* and 36*c* disposed on the upper end side and the lower end side of the grind part 34 are set to be substantially the same. On the other hand, the spring constant of the coil spring 36*b* disposed at substantially the intermediate height of the grind part 34 is selected to be larger than, for example, approximately twice or three times as large as, the spring constant of the coil springs 36*a* and 36*c*. However, it is possible to use coil springs 36*a*, 36*b* and 36*c* having substantially the same spring constant if necessary.

The honing head 30 having the aforementioned structure is attached to a lower end portion of a spindle 1 of a honing machine, the honing head 30 is inserted into a worked hole of a workpiece, and grind-stone-mounts 32 are expanded in the radial directions so as to bring grinding faces of grind stones 35 into pressure contact with the inside face of the worked hole of the workpiece. The honing of the worked hole is performed by vertically moving the spindle 1 while rotating in this state.

In using the grind-stone-mounts 32 of the honing head 30 in the honing, the grind part 34 may be swung against the support part 33 with the coil spring 36*b* used as a fulcrum when the spring constants of the coil springs 36*a*, 36*b* and 36*c* are selected as described above.

In other words, the grinding face of the grind part 34 (namely, the grinding face of the grind stone 35) may face to a vertical plane parallel to the axial direction of a holder 31. Therefore, in the case where the worked hole of the workpiece has a vertical face parallel to the axial direction, the grinding face of the grind part 34 may smoothly follow the vertical face of the worked hole.

Furthermore, in the case where, for example, an inward external force is applied to the upper end side of the grinding face of the grind part 34, the coil spring 36*a* may be shrunk. Therefore, the grinding face of the grind part 34 may be inclined from the vertical plane to a direction where the upper end side of the grinding face of the grind part 34 is close to the support part 33. Therefore, in the case where the worked hole of the workpiece has a portion shifted from the direction parallel to the axial direction to the inclined direction, the grinding face of the grind part 34 may smoothly follow the inclined face of the worked hole.

Alternatively, in the case where, for example, an inward external force is applied to the lower end side of the grinding face of the grind part 34, the coil spring 36*c* may be shrunk. Therefore, the grinding face of the grind part 34 may be inclined from the vertical plane to a direction where the lower end side of the grinding face of the grind part 34 is close to the support part 33. Therefore, in the case where the worked hole of the workpiece has a portion shifted from the direction parallel to the axial direction to the inclined direction, the grinding face of the grind part 34 may smoothly follow the inclined face of the worked hole.

In addition, the grinding face of the grind part 34 may keep the contact pressure of the grind stone 35 substantially constant because a radial length from the central axis of the holder 31 to the grinding face may be increased/decreased by extending/shrinking the coil springs 36*a*, 36*b* and 36*c* in accordance with an external force applied by the worked hole of the workpiece. Additionally, the radial length may be increased/decreased when the grinding face of the grind part 34 follows a vertical face or when it follows a face inclined in any of the directions.

Accordingly, the grinding face of the grind part 34 may smoothly follow the inside shape of the worked hole of the workpiece, and as a result, the honing (including rough machining and surface finishing) may be performed while keeping a shape of a non-circular cross section obtained through boring without scraping the original shape of the non-circular cross section otherwise scraped to be closer to a shape of a circular cross section.

Figure 4:
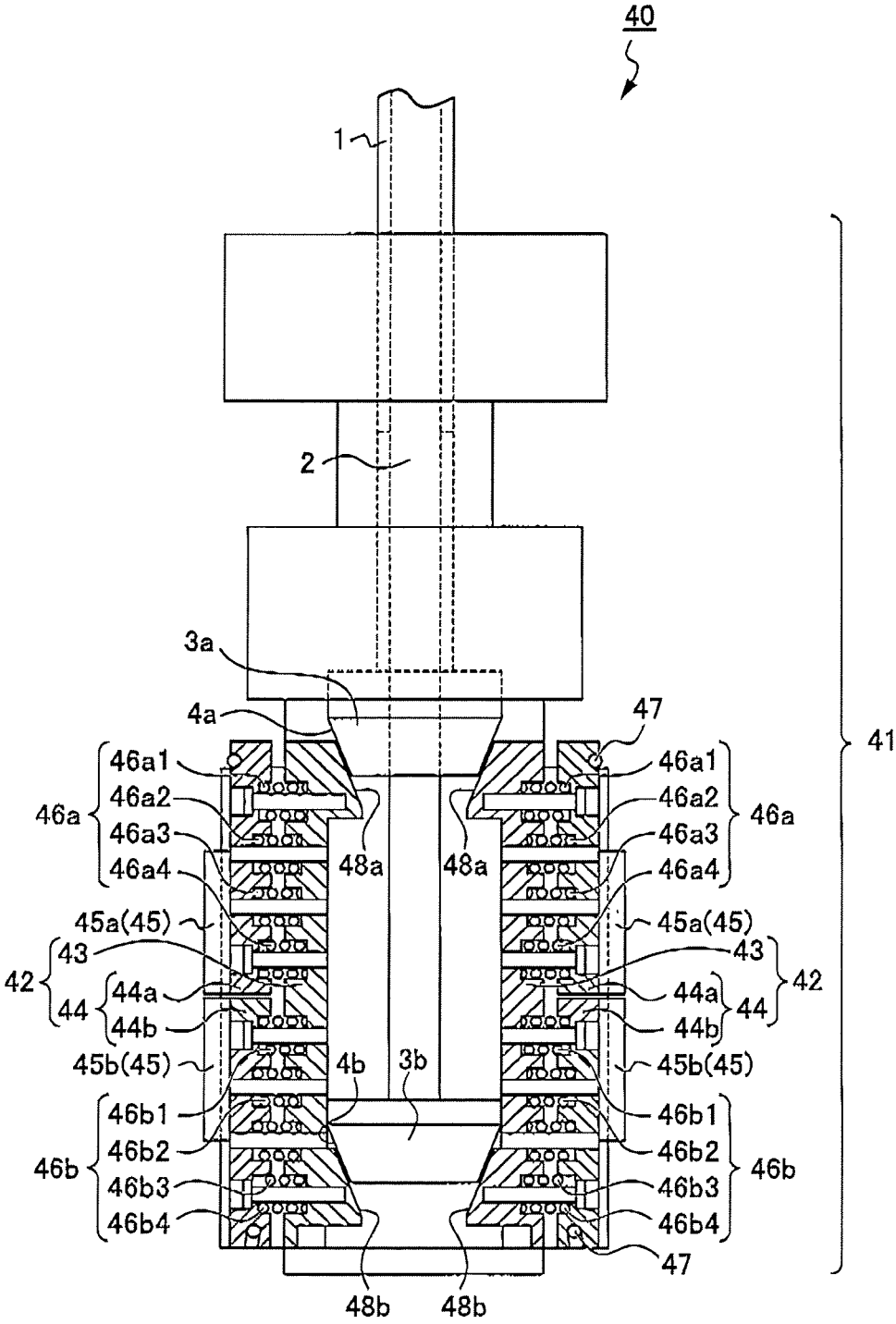
FIG. 4 is a schematic vertical cross-sectional view of a honing head including a grind-stone-mount according to a fourth exemplary embodiment of the invention.

FIG. 4 is a schematic vertical cross-sectional view of a honing head 40 including a grind-stone-mount 42 according to a fourth exemplary embodiment of the invention.

The honing head 40 of FIG. 4 is substantially the same as the honing head 10 of FIG. 1, and hence, reference numerals respectively obtained by adding 30 to the reference numerals used in FIG. 1 are used to refer to like elements, so as to avoid repetition of the description.

As illustrated in FIG. 4, the grind-stone-mount 42 is dividedly constructed by a support part 43 disposed inside along the radial direction and a grind part 44 having a grind stone 45 and disposed outside along the radial direction. The grind part 44 further includes a plurality of grind stone members 44*a* and 44*b* dividedly along the axial direction of a holder 41. The grind stone members 44*a* and 44*b* are attached to the support part 43 swingably with one or a plurality of spring members 46*a* and 46*b* disposed at intervals along the axial direction of the holder 41. In FIG. 4, the grind stone member 44*a* is provided with four spring members 46*a*1, 46*a*2, 46*a*3 and 46*a*4, and the grind stone member 44*b* is also provided with four spring members 46*b*1, 46*b*2, 46*b*3 and 46*b*4. At this point, each of the spring members 46*a* and 46*b* is preferably a coil spring.

In this case, spring constants of the coil springs 46*a* are preferably selected as follows: For example, the spring constants of the coil springs 46*a*1 and 46*a*4 disposed on the upper end side and the lower end side of the grind stone member 44*a* are set to be substantially the same. On the other hand, the spring constants of the coil springs 46*a*2 and 46*a*3 disposed in the vicinity of an intermediate height of the grind stone member 44*a* are set to be substantially the same. Then, the Spring constant of the coil springs 46*a*2 and 46*a*3 disposed in the vicinity of the intermediate height is selected to be larger than, for example, approximately twice as large as, the spring constant of the coil springs 46*a*1 and 46*a*4 disposed on the upper and lower end sides.

The spring constants of the coil springs 46*b*1, 46*b*2, 46*b*3 and 46*b*4 are also preferably selected in the same manner as the spring constants of the coil springs 46*a*1, 46*a*2, 46*a*3 and 46*a*4.

The honing head 40 having the aforementioned structure is attached to a lower end portion of a spindle 1 of a honing machine, the honing head 40 is inserted into a worked hole of a workpiece, and grind-stone-mounts 42 (the grind stone members 44*a* and 44*b*) are expanded in the radial directions so as to bring grinding faces of grind stones 45 (45*a* and 45*b*)

into pressure contact with the inside face of the worked hole of the workpiece. The honing of the worked hole is performed by vertically moving the spindle 1 while rotating in this state.

In using the grind-stone-mounts 42 of the honing head 40 in the honing, the grind stone member 44*a* may be swung in regard to the support part 43 with the coil springs 46*a*2 and 46*a*3 used as a fulcrum when the spring constants of the coil springs 46*a*1, 46*a*2, 46*a*3 and 46*a*4 are selected as described above. Similarly, when the spring constants of the coil springs 46*b*1, 46*b*2, 46*b*3 and 46*b*4 are selected in the same manner as the spring constants of the coil springs 46*a*1, 46*a*2, 46*a*3 and 46*a*4, the grind stone member 44*b* may be swung in regard to the support part 43 with the coil springs 46*b*2 and 46*b*3 used as a fulcrum.

In other words, the grinding faces of the grind stone members 44*a* and 44*b* (namely, the grinding faces of the grind stones 45*a* and 45*b*) may face to a vertical plane parallel to the axial direction of the holder 41. Therefore, in the case where the worked hole of the workpiece has a vertical face parallel to the axial direction, the grinding faces of the grind stone members 44*a* and 44*b* may smoothly follow the vertical face of the worked hole.

Furthermore, in the case where, for example, an inward external force is applied to the upper end side of the grinding face of the grind stone member 44*a* and an inward external force is applied to the lower end side of the grinding face of the grind stone member 44*b*, the coil spring 46*a*1 may be shrunk and the coil spring 46*b*4 may be shrunk. Therefore, the grinding face of the grind stone member 44*a* may be inclined from the vertical plane to a direction where the upper end side of the grinding face of the grind stone member 44*a* is close to the support part 43 and the grinding face of the grind stone member 44*b* may be inclined to a direction where the lower end side of the grinding face of the grind stone member 44*b* is close to the support part 43. Therefore, in the case where the worked hole of the workpiece has a portion shifted from the direction parallel to the axial direction to the inclined direction, the grinding faces of the grind stone members 44*a* and 44*b* may smoothly follow the inclined face of the worked hole.

Alternatively, in the case where, for example, an inward external force is applied to the lower end side of the grinding face of the grind stone member 44*a* and an inward external force is applied to the upper end side of the grinding face of the grind stone member 44*b*, the coil spring 46*a*4 may be shrunk and the coil spring 46*b*1 may be shrunk. Therefore, the grinding face of the grind stone member 44*a* may be inclined from the vertical plane to a direction where the lower end side of the grinding face of the grind stone member 44*a* is close to the support part 43 and the grinding face of the grind stone member 44*b* may be inclined to a direction where the upper end side of the grinding face of the grind stone member 44*b* is close to the support part 43. Therefore, in the case where the worked hole of the workpiece has a portion shifted from the direction parallel to the axial direction to the inclined direction, the grinding faces of the grind stone members 44*a* and 44*b* may smoothly follow the inclined face of the worked hole.

In addition, the grinding face of the grind stone member 44*a* may keep the contact pressure of the grind stone 45*a* substantially constant because a radial length from the central axis of the holder 41 to the grinding face may be increased/decreased by extending/shrinking the coil springs 46*a*1, 46*a*2, 46*a*3 and 46*a*4 in accordance with an external force applied by the worked hole of the workpiece. Similarly, the grinding face of the grind stone member 44*b* may keep the contact pressure of the grind stone 45*b* substantially constant because the radial length from the central axis of the holder 41 to the grinding face may be increased/decreased by extending/shrinking the coil springs 46*b*1, 46*b*2, 46*b*3 and 46*b*4 in accordance with an external force applied by the worked hole of the workpiece. Additionally, the radial length may be increased/decreased when the grinding faces of the grind stone members 44*a* and 44*b* follow a vertical face or when they follow a face inclined in any of the directions.

Accordingly, the grinding faces of the grind stone member 44*a* and 44*b* may smoothly follow the inside shape of the worked hole of the workpiece, and as a result, the honing (including rough machining and surface finishing) may be performed while keeping a shape of a non-circular cross section obtained through boring without scraping the original shape of the non-circular cross section otherwise scraped to be closer to a shape of a circular cross section.

INDUSTRIAL APPLICABILITY

The present invention is applicable to a grind-stone-mount of a honing head capable of honing an inside diameter of a hole formed in a workpiece in a shape of a non-circular cross section.

DESCRIPTION OF REFERENCE NUMERALS

1 spindle
10, 20, 30, 40 honing head
11, 21, 31, 41 holder
12, 22, 32, 42 grind-stone-mount
13, 23, 33, 43 support part
14, 24, 34, 44 grind part
44*a*, 44*b* grind stone member
15, 25, 35, 45, 45*a*, 45*b* grind stone
16, 26*a*, 26*b*, 36*a*, 36*b*, 36*c*, 46*a*, 46*b* coil spring (spring member)

The invention claimed is:

1. A grind-stone-mount of a honing head, in which a plurality of grind-stone-mounts each having a grind stone on its outer side are to be attached to a holder of the honing head expandably along a radial direction, the grind-stone-mount comprising:

a support part disposed inside along the radial direction; and a grind part including said grind stone and disposed outside along the radial direction, wherein the grind part is swingably attached to the support part through a plurality of coil springs disposed at intervals along an axial direction of the holder, wherein an axis of each said coil springs extends in the radial direction from a central axis of the holder to outside of the holder, and wherein one said coil spring disposed at an intermediate portion of the grind part along the axial direction of the holder has a spring constant which is larger than spring constants of the other said coil springs.

2. The grind-stone-mount of a honing head according to claim 1, wherein the grinding face of the grind part is disposed so as to be inclined from parallel to the central axis of the holder so that one end side of the grinding face of the grind part is closer to a corresponding end side of the support part and an opposite end side of the grinding face of the grind part is farther from a corresponding opposite end side of the support part.

3. The grind-stone-mount of a honing head according to claim 1, wherein the central axis of the holder extends vertically, and the grinding face of the grind part is disposed so as to be inclined from a vertical plane so that a distance between an upper end side of the grinding face of the grind part and an upper end side of the support part is smaller than a distance between a lower end side of the grinding face of the grind part and a lower end side of the support part.

4. The grind-stone-mount of a honing head according to claim 1, wherein the central axis of the holder extends vertically, and the grinding face of the grind part is disposed so as to be inclined from a vertical plane so that a distance between an upper end side of the grinding face of the grind part and an upper end side of the support part is larger than a distance between a lower end side of the grinding face of the grind part and a lower end side of the support part.

* * * * *